US005456741A

United States Patent [19]

Takahara et al.

[11] Patent Number: 5,456,741

[45] Date of Patent: Oct. 10, 1995

[54] AIR PURIFIER

[75] Inventors: Toshihiro Takahara, Chiryu; Kenichi Katou, Nagoya; Masakazu Takeichi, Okazaki, all of Japan

[73] Assignees: Nippondenso Co., Ltd., Kariya; Nippon Soken Inc., Nishio, both of Japan

[21] Appl. No.: 70,529

[22] Filed: Jun. 3, 1993

[30] Foreign Application Priority Data

Jun. 4, 1992 [JP] Japan ..... 4-170250
Oct. 15, 1992 [JP] Japan ..... 4-302988

[51] Int. Cl.[6] ..... B03C 3/155

[52] U.S. Cl. ..... 96/22; 95/6; 96/57; 96/59; 96/67; 96/96; 96/97

[58] Field of Search ..... 96/22, 55, 59, 96/63, 66–68, 80, 97, 57, 96; 95/6, 70

[56] References Cited

U.S. PATENT DOCUMENTS

| | | | |
|---|---|---|---|
| 1,909,825 | 5/1933 | Hahn et al. | 95/6 |
| 2,593,377 | 4/1952 | Wintermute | 95/70 |
| 4,177,045 | 12/1979 | Orel | 96/22 X |
| 4,624,685 | 11/1986 | Lueckenotte et al. | 96/22 X |
| 4,689,715 | 8/1987 | Halleck | 96/97 X |

FOREIGN PATENT DOCUMENTS

| | | |
|---|---|---|
| 54-151090 | 11/1979 | Japan . |
| 56-91859 | 7/1981 | Japan . |
| 59-209664 | 11/1984 | Japan . |
| 61-64528 | 4/1986 | Japan . |
| 3-4361 | 2/1991 | Japan . |

*Primary Examiner*—Richard L. Chiesa
*Attorney, Agent, or Firm*—Cushman, Darby & Cushman

[57] ABSTRACT

An air purifier has discharge electrodes which generate a corona emission. These discharge electrodes are disposed within a flow passage provided in the air purifier along with a blower. Also included in the air purifier is a filter which scavenges contaminant particles in the air charged by the discharge electrodes. A control unit detects a discharge current of the discharge electrodes to control a rotational speed of the blower in accordance with the detected emission current.

8 Claims, 8 Drawing Sheets

AIR PURIFIER

BACKGROUND OF THE INVENTION

The present invention relates to air purifiers and, more particularly, to an air purifier in which a degree of contamination of air is detected to perform adequate operations.

As an air purifier of the kind referred to above, there is one disclosed, for example, in Japanese Patent Laid-Open No. 61-64528. This air purifier is arranged such that light emitted from a light emitting element and scattered by contaminated particles within the air is detected by a light receiving element to determine a degree of contamination of the air. A rotation speed of a blower in an air flow passage provided with a scavenging filter is controlled accordingly. Therefore, a useless or ineffective operation or running of the blower is avoided so as to be capable of reducing the generation of noises and the load of the battery.

On the other hand, in place of removal of the contaminated particles due to the scavenging filter, another arrangement is known (refer to Japanese Patent Laid-Open No. 56-91859), in which the contaminated air flows between electrodes which generate a corona discharge. The contaminated particles in the air are charged and then scavenged effectively or efficiently by downstream scavenging electrodes. In this case, in order to prevent detecting accuracy from being deteriorated by adhesion of the contaminated particles, an electrode for detecting the contaminated particles is additionally provided in place of the above-described light emitting element.

In connection with the above, Japanese Patent Laid-Open Nos. 54-151090 and 56-91859 also disclose such a detecting electrode.

However, for the aforementioned prior art arrangement, since the additional electrode for detecting the degree of contamination of the air is required to be additionally provided, secureness of an establishment location, time of assembling and the like cause new problems. Further, since corona discharge occurs also between the discharge electrode and the detecting electrode, there is a problem that a charge efficiency of the particle is reduced.

OBJECT AND SUMMARY OF THE INVENTION

The invention intends to solve the above-discussed problems. It is an object of the present invention to provide an air purifier in which a detecting electrode is dispensed with to realize a simplification of a structure and a reduction in size, and which improves a scavenging efficiency of the contaminated particles.

DETAILED DESCRIPTION OF THE PRESENTLY PREFERRED EXEMPLARY EMBODIMENTS

[FIRST EMBODIMENT]

Figure 1:
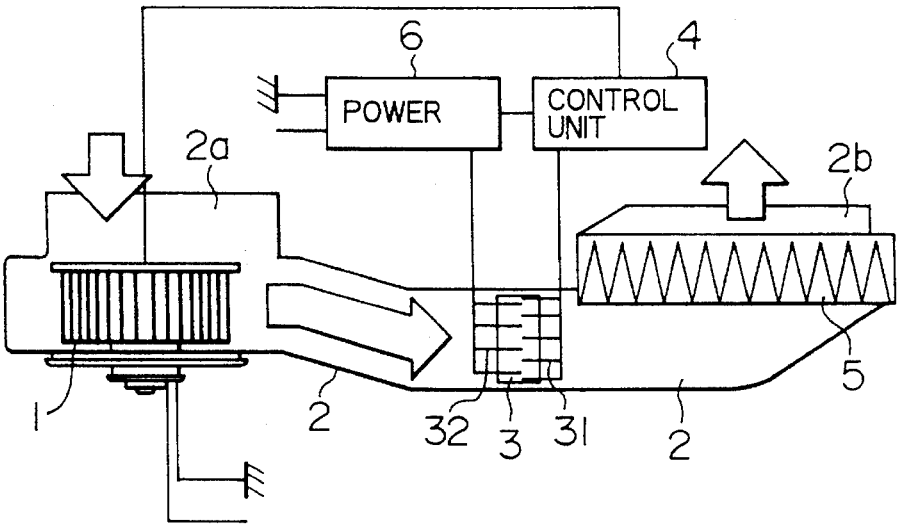
FIG. 1 is an entire schematic cross-sectional view showing an air purifier.

In FIG. 1, an air purifier according to a first embodiment includes a housing 2 defining an air flow passage which opens at both longitudinal ends thereof. The air purifier is equipped, for example, in a vehicle compartment. A blower 1 is arranged within a portion of the housing 2 adjacent one opening 2*a*. The blower 1 sucks or draws the air through the opening 2*a* and sends it to the downstream of the air flow passage. A discharge electrode (ionizer) 3, which will be described later in detail, is provided in the air flow passage. A scavenging filter 5 having a charged fiber is provided at the other opening 2*b* at the downstream side of the housing 2.

The ionizer 3 has a pair of electrodes 31 and 32 which are opposed against each other. The electrode 31 is connected to a control unit 4, while the electrode 32 is connected to a high voltage power source 6. The blower 1 is controlled in rotation by the control unit 4 as described later.

Figure 2:
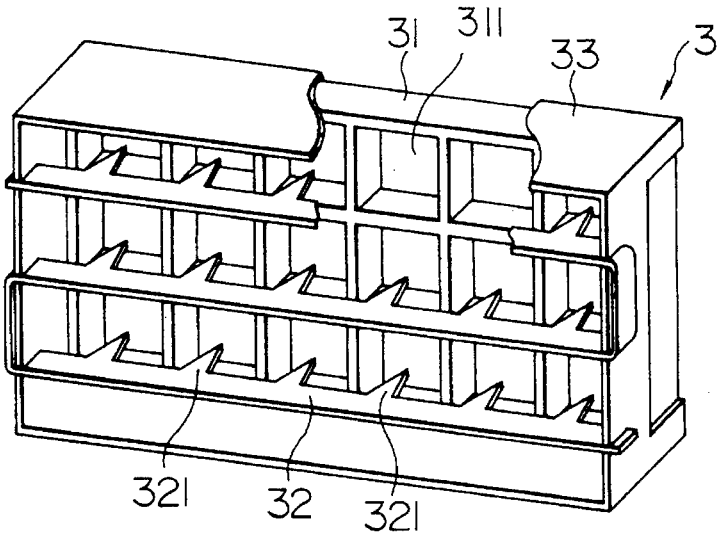
FIG. 2 is a broken-away perspective view showing an ionizer shown in FIG. 1.
Figure 3:
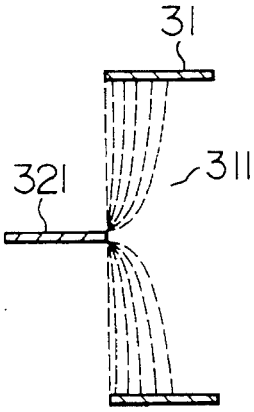
FIG. 3 is a partially enlarged cross-sectional view of the ionizer.

The ionizer 3 has a rectangular frame case 33 made of insulating resin (FIG. 2). The electrodes 31 and 32 are retained by the frame case 33 so that the electrode 31 is located at a downstream side, and the electrode 32 is located an upstream side. The electrode 31 is made of a conductive metal and is in the form of a grid body or lattice defining a plurality of square spaces 311 through which the air passes. On the other hand, the electrode 32 is formed such that a conductive metal strip is bent or .curved. A plurality of triangular projections 321 formed at a side edge of the electrode 32 have respective tips or forward ends thereof which are located respectively at centers of the respective square lattice spaces 311 of the electrode 31. As shown in FIG. 3, the forward ends of the respective triangular projections 321 terminate points thereof on a plane connecting the lattice end faces of the electrode 31 so that a parallel or an overlapping portion between the forward end of each of the projections 321 and a lattice wall surface in a transverse direction is minimized.

When a high voltage is applied to the electrodes 31 and 32, a strong electric field is generated between the forward end of each of the triangular projections 321 and the surrounding lattice wall surfaces of the electrode 31, as shown by broken lines in FIG. 3, so that a corona discharge occurs. All air passing through the lattice spaces 311 passes through the corona discharge sections. Since there is no parallel or overlapping portion between the electrodes 31 and 32, a distribution of the electric field becomes remarkably uneven or un-uniform. As a result, the corona discharge occurring between the electrodes 31 and 32 is extremely stabilized.

Figure 4:
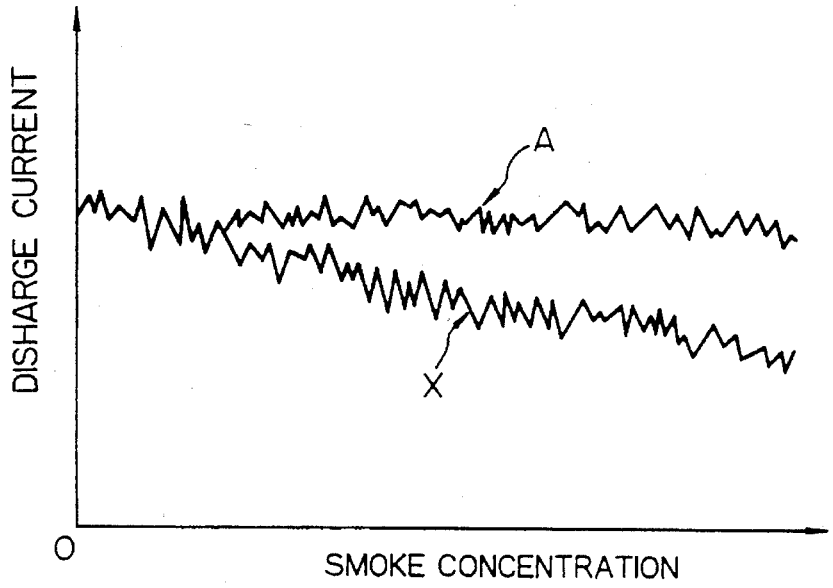
FIG. 4 is a graph showing the relationship between discharge current and a smoke concentration or smoke density.

A contaminated particle within the air is charged while it passes through the corona discharge and takes away negative ions. Accordingly, as apparent from a graph X in FIG. 4, a value of the emission current decreases as concentration of the tobacco smoke contaminated particles increases. In this connection, a graph A indicates a value of the discharge current in the case where there is no tobacco smoke.

Figure 5A:
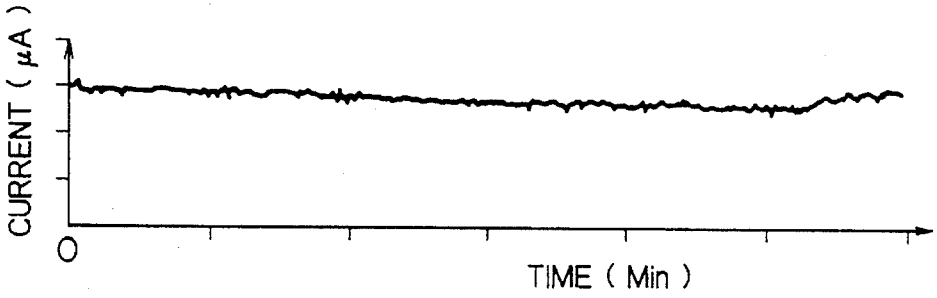
FIGS. 5A and 5B are views each showing a change of the discharge current with the passage of time.
Figure 5B:
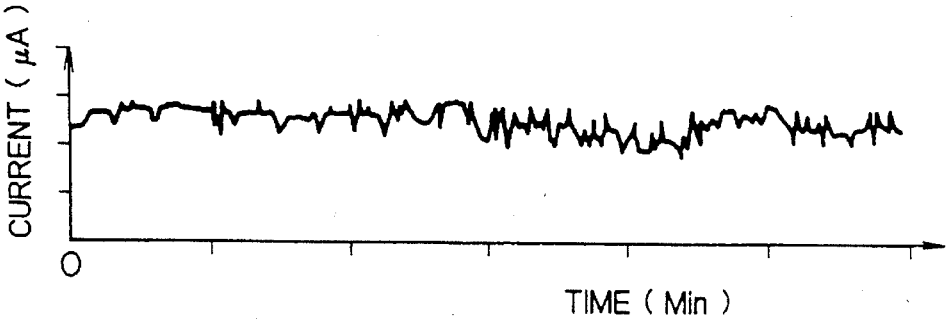
FIG. 5B (PRIOR ART)

With regard to the stability of the discharge current, the discharge current in the above-described arrangement of the ionizer 3 is sufficiently stabilized as shown in FIG. 5A, as compared with a conventional structure shown in FIG. 5B.

Figure 6:
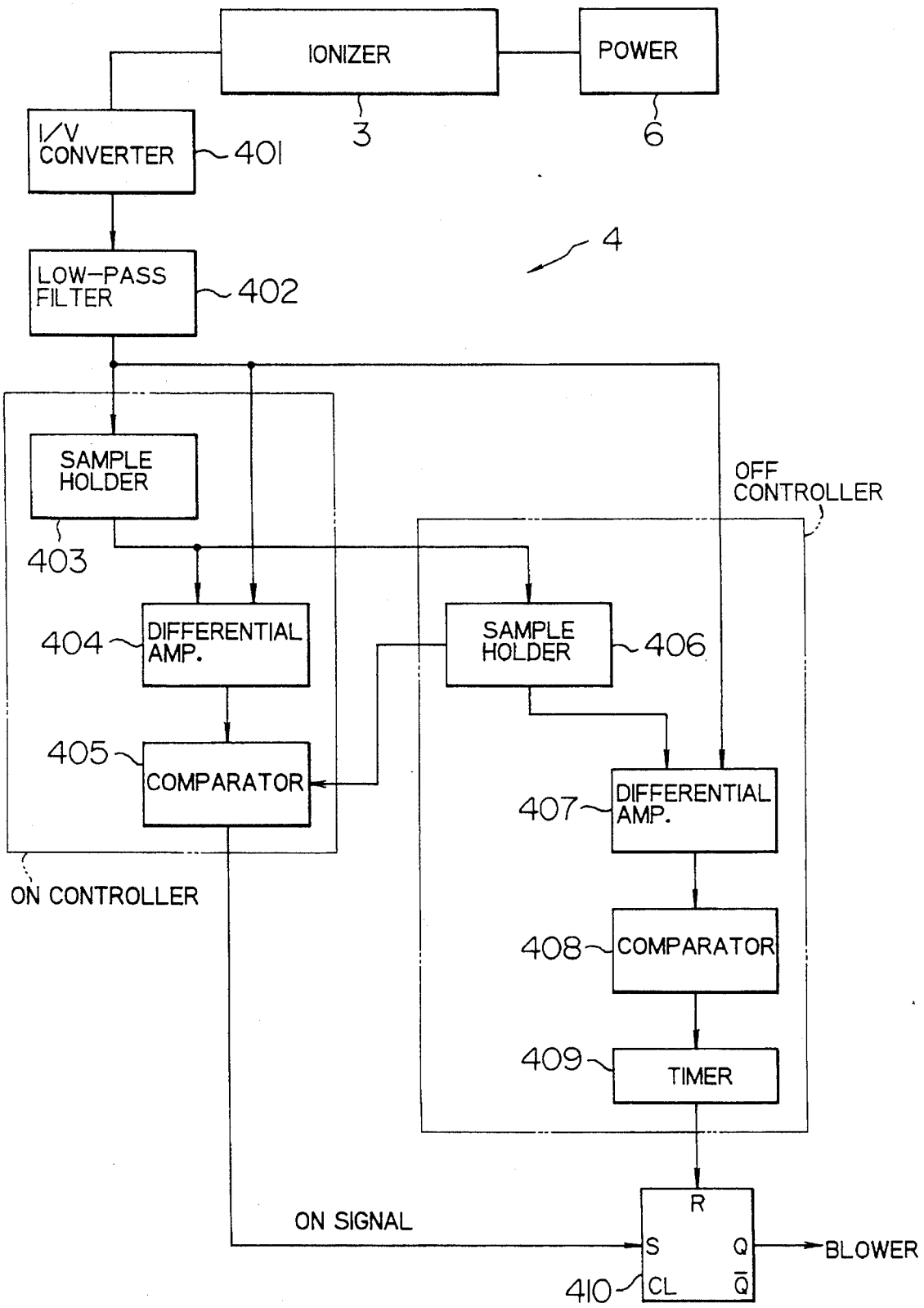
FIG. 6 is a block diagram of a control unit shown in FIG. 1.

An arrangement and operation of the control unit 4 will be described with reference to FIG. 6. An I/V converting circuit 401 connected to the electrode 31 of the ionizer 3 converts the discharge current to a voltage signal. The voltage signal is inputted, through a low-pass filter 402, to a sample hold circuit 403 which forms an ON control circuit. The sample hold circuit 403 samples a voltage signal at a predetermined intervals (10 seconds, for example) and outputs the voltage signal to a differential amplification circuit 404. The differential amplification circuit 404 generates a signal corresponding to a difference between the sample signal and the voltage signal of the low-pass filter 402. A comparator 405 generates an ON signal when the difference signal exceeds a predetermined value to set a flip flop 410. Thus, a signal for activating the blower 1 is output from a Q-terminal of the flip flop 410.

Specifically, when the person smokes within the vehicle compartment, the smoke particle within the air increases so that the discharge current decreases. Thus, the voltage signal from the I/V converting circuit 401 decreases. As a result, the difference signal of the differential amplification circuit 404 exceeds the predetermined value, and then the blower 1 proceeds from a low-speed rotation to a desired high-speed rotation. The contaminated air within the compartment is quickly sucked or drawn through the opening 2*a*, and the smoke particle charged negatively during corona discharge of the ionizer 3 is sent to the scavenging filter 5. At the scavenging filter 5, the smoke particles are efficiently caught by the charged fiber which is polarized positively.

At the time an ON signal is generated by the comparator 405, a sample hold circuit 406 forming an OFF control circuit operates so that the sample signal of the sample hold circuit 403 under a condition that the smoke particle increases is communicated to the sample hold circuit 406.

When the person stops smoking, the smoke particle in the air decreases. Accordingly, a voltage signal of the low-pass filler 402 rises. When the difference signal of a differential amplification circuit 407 exceeds a predetermined value, an output signal from a comparator 408 is inverted. When this condition is sustained or maintained for a predetermined period of time, an OFF signal is output from a timer 409 so that the blower 1 is returned to the desired low-speed rotational operation.

In the operation of the air purifier, since the corona discharge in the ionizer 3 is stabilized and established over an entire area within the lattice spaces 311 of the electrode 31, all of the air passes through the corona discharge portion. Accordingly, a charging efficiency of the smoke particle is superior, and the smoke concentration can be detected accurately in accordance with the change of the discharge current. Furthermore, the smoke particle can be effectively scavenged.

[SECOND EMBODIMENT]

Figure 7:
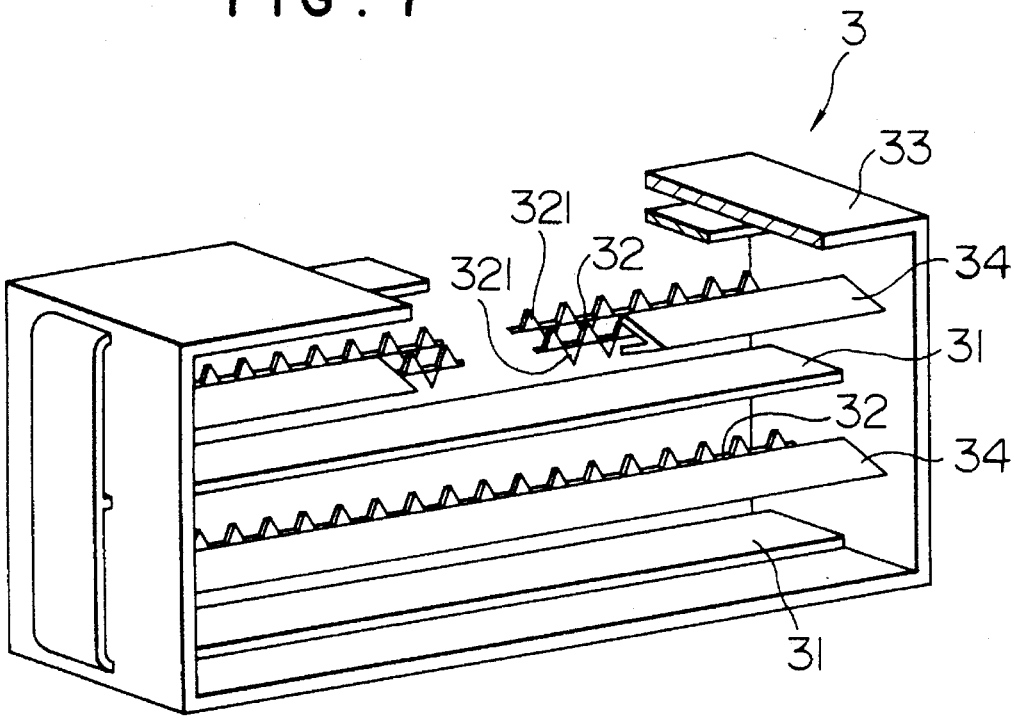
FIG. 7 is a broken-away perspective view showing an another example of the ionizer.

Referring to FIG. 7, an ionizer 3 used in another embodiment includes electrodes 31 and 32. The electrodes 31 are horizontally disposed at an upper, a lower and an intermediate part of a frame case 33, respectively. Each of the electrodes 32 are also horizontally disposed at a centre between adjacent electrodes 31 and 31. The electrodes 32 are apart from each other not only vertically but also horizontally. A plurality of triangle projections 321 and 322 are provided at opposite edges of the electrode 32 such that the triangle projections 321 on one edge alternate with the triangle projections 322 on the other edge. These projections 321 and 322 converge towards the respective electrodes 31 on the pinpoints. Moreover, an air guide plate 34 which is flared downstream side is provided at an upstream side of the electrode 32 along the same.

Figure 8:
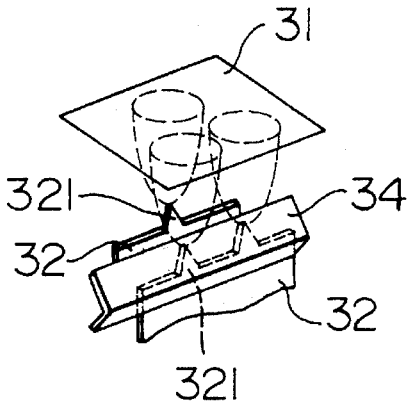
FIG. 8 is a partially enlarged fragmentary perspective view of the ionizer, showing discharge condition.
Figure 9:
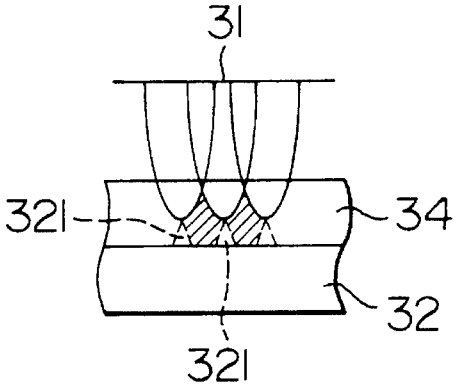
FIG. 9 is a partially enlarged front elevational view of the ionizer, showing the discharge condition.

When a high voltage is applied between the electrodes 31 and 32, a spindle-like discharge occurs between a pinpoint end of the respective triangular projections 321, 322 of the electrode 32 and the electrode 31, as shown in FIG. 8. The dead spaces in which the discharge is not performed as indicated by oblique lines in FIG. 9 occur between the adjacent projections. Since, however, the air flows to avoid the dead spaces due to the air guide plates 34, the smoke particles in the air are efficiently charged.

[THIRD EMBODIMENT]

Figure 10:
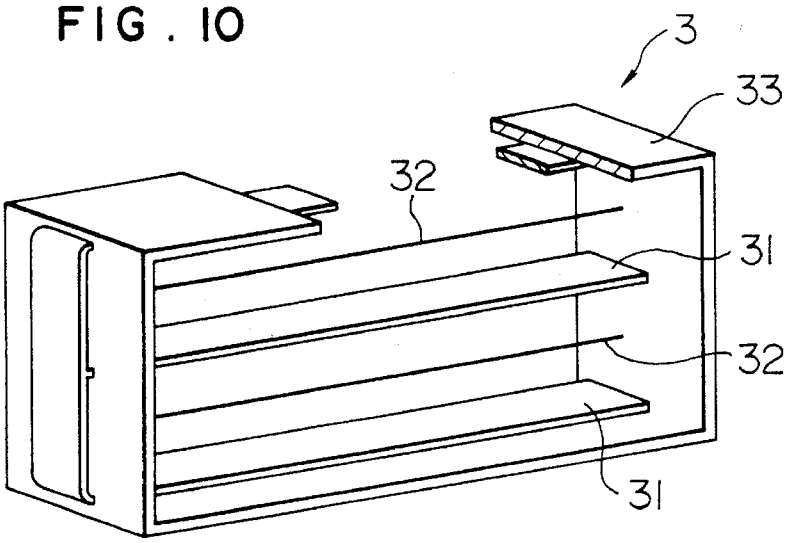
FIG. 10 is a broken-away perspective view showing a still another example of the ionizer.

Referring to FIG. 10, an ionizer 3 used in still another embodiment also includes electrodes 31 and 32. The electrodes 31 are the same in structure as those in the second embodiment. Each of the electrodes 32 is a wire which is disposed horizontally at a centre between the electrodes 31 and 31.

A parallel or an overlapping portion between the electrodes 31 and 32 in a transverse direction is extremely short. Accordingly, an electric field formed between the electrodes 31 and 32 is non-uniform. Thus, there is produced steady or stabilized corona discharge with a simple structure.

In connection with the above, the speed of the blower 1 is alternated between a high speed and a low speed with respect to the smoke concentration. However, it may be possible to vary a speed of the blower 1 linearly or continuously with respect to the smoke concentration.

[FOURTH EMBODIMENT]

Figure 11:
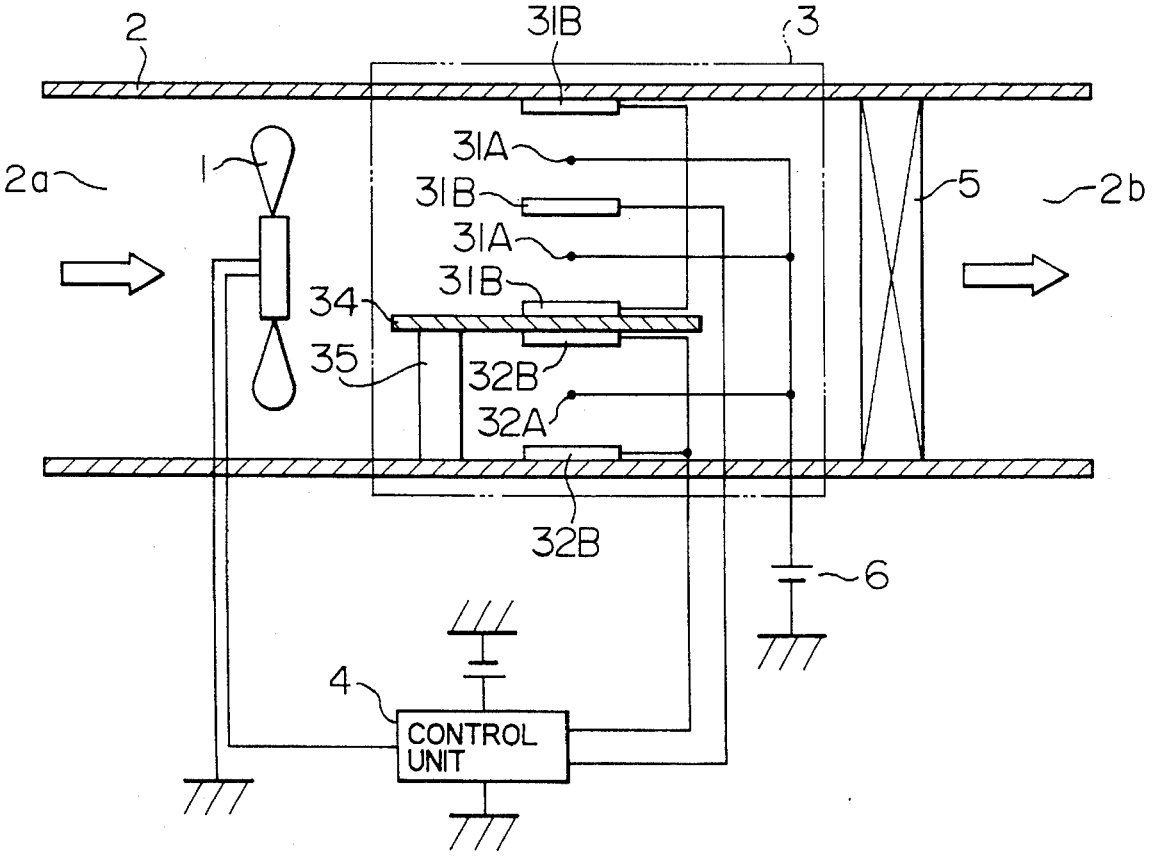
FIG. 11 is an entire schematic cross-sectional view of an air purifier according to a fourth embodiment of the invention.

An air purifier according to a fourth embodiment of the invention includes, as shown in FIG. 11, a housing 2 defining therein an air flow passage which opens at both ends of the housing 2. A blower 1 is disposed within the housing 2 to draw the air from one opening 2*a* thereof and to send it downwardly. An ionizer 3 is provided at a portion in the air flow passage located downstream of the blower 1.

A scavenging filter 5 made of charged fiber is provided at the other opening 2*b* of the housing 2.

Figure 12:
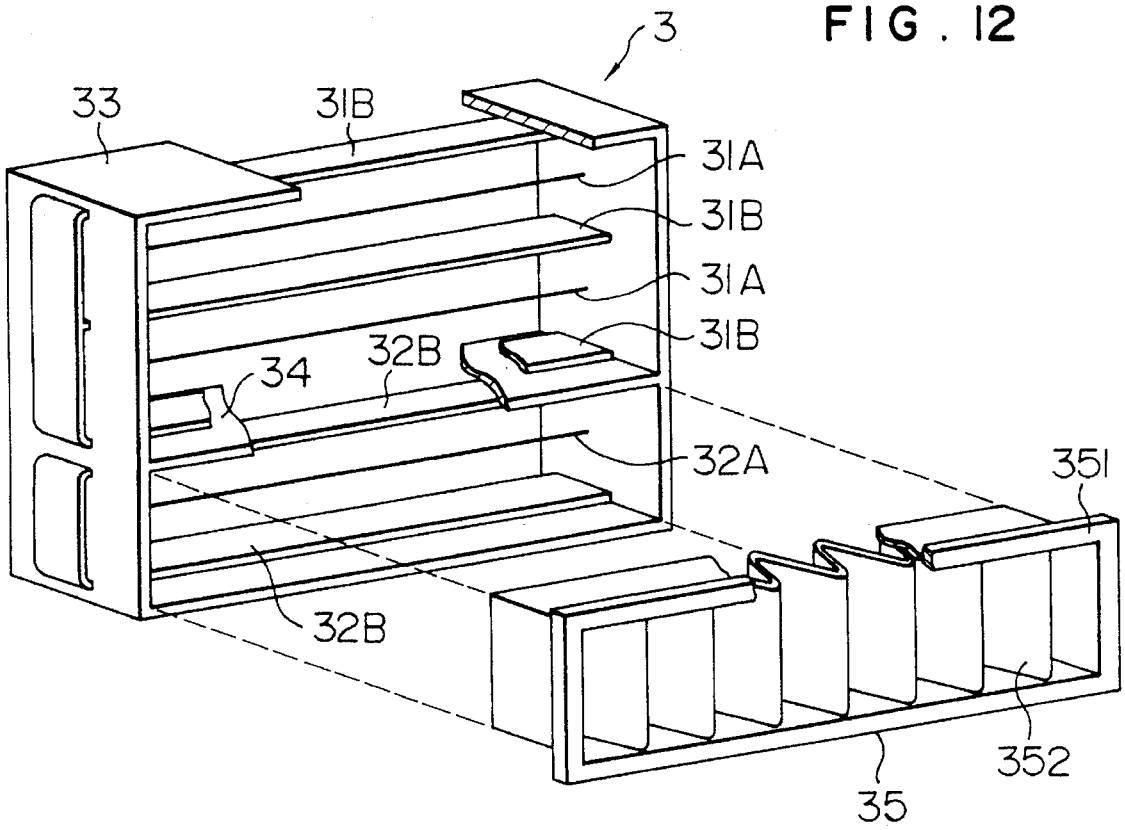
FIG. 12 is a broken-away perspective view showing an ionizer shown in FIG. 11.

The ionizer 3 has discharge electrodes 31A and 31B, and reference electrodes 32A and 32B, as shown in detail in FIG. 12. The ionizer 3 also has a rectangular frame case 33 made of an insulating resin. An interior of the frame case 33 is partitioned into an upper half and a lower half in a 2: 1 ratio by means of a partition wall 34. The plurality of discharge electrodes 31B of metal plates are horizontally arranged within the upper frame half and vertically spaced from one another. The wire discharge electrode 31A is horizontally arranged so as to extend a centre between the adjacent discharge electrodes 31B and 31B.

The reference electrodes 32A and 32B arranged within the lower frame half are the same in structure as the discharge electrodes 31A and 31B, respectively. However, the numbers of the reference electrodes 32A and 32B is less than those of the electrodes 31A and 32A. A dust separator 35 for removing smoke particles that are contaminated particles in the air is provided in an opening of the lower frame half of the frame case 33, which is located upstream of the reference electrodes 32A and 32B. The dust separator 35 includes a frame case 351 made of an insulating resin which is detachably fitted into the opening in the lower frame half of the frame case 33 and a filter 352 made of elongated nonwoven fabric folded alternately which is retained within the frame case 351. Therefore, the filter 352 permits water molecules to pass through and can adequately be replaced with a new one.

As shown in FIG. 11, the discharge electrodes 31A and the reference electrodes 32A are connected to a high voltage power source 6, while the discharge electrodes 31B and the reference electrodes 32B are connected to a control unit 4. A signal is output from the control unit 4 in accordance with the discharge current level so as to operate the blower 1.

Figure 13:
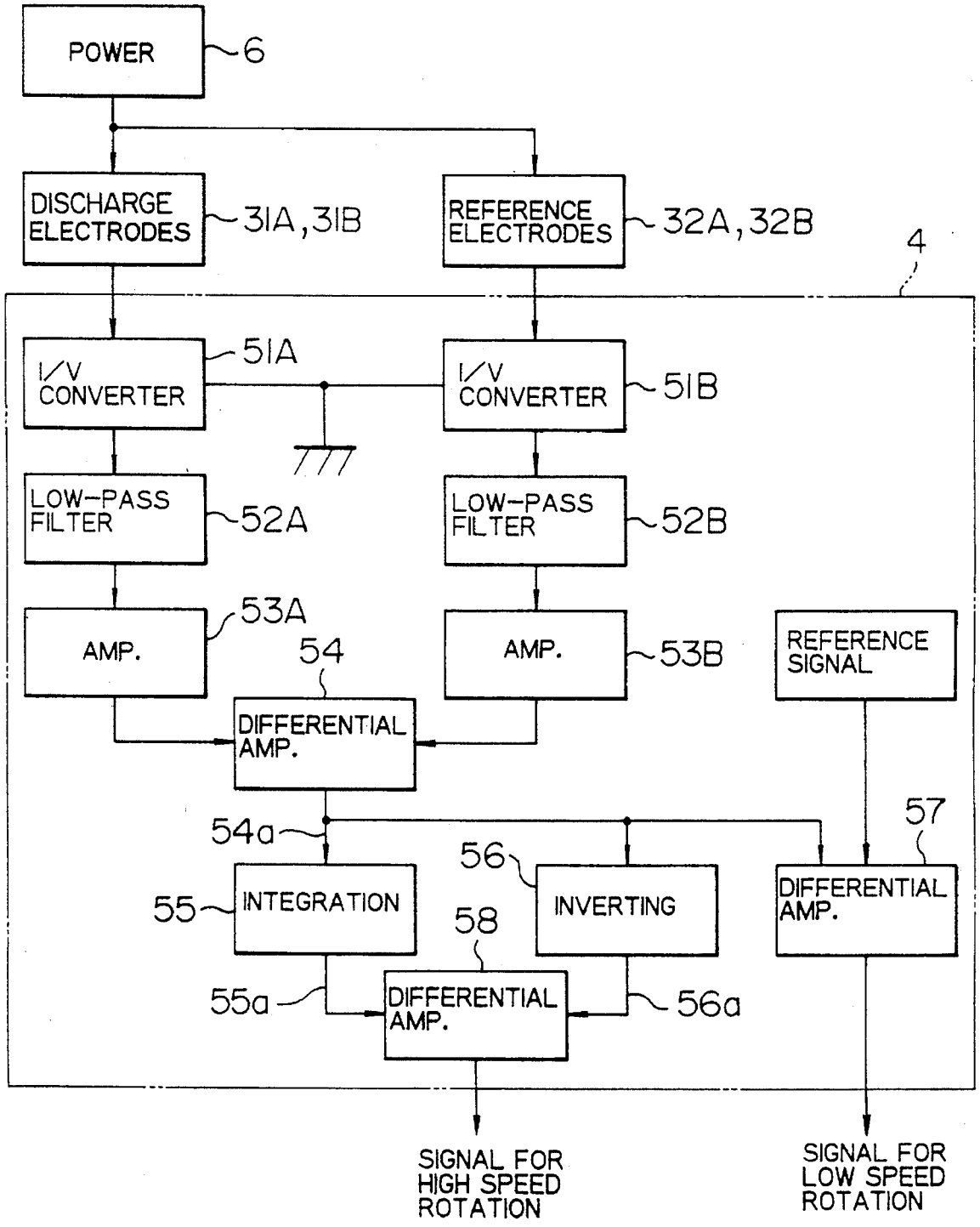
FIG. 13 is a block diagram of a control unit shown in FIG. 11.

In the control unit 4, as shown in FIG. 13, the discharge currents of the respective electrodes 31A, 31B, 32A and 32B are converted into the voltages respectively by I/V converting circuits 51A and 51B, which are inputed to amplification circuits 53A and 53B through low-pass filters 52A and 52B, respectively. Since the reference electrodes 32A and 32B are less in the number than the discharge electrodes 31A and 31B, the discharge currents are correspondingly low. Therefore, an amplification factor of the amplification circuit 53B is raised to take a balance between amplification signals. By doing so, it can be possible to make the ionizer compact by reducing the number of the reference electrodes 32A and 32B.

The amplification signals are inputed to a differential amplification circuit 54 from which an output signal 54*a* corresponding to a difference therebetween is output. The output signal 54*a* is inputed to an integration circuit 55, a reverse amplification circuit 56 and a differential amplification circuit 57, respectively. An integration of the signal 54*a* is needed to detect an offset thereof. An integrating signal 55*a* from the integration circuit 55 and a signal 56*a* which is obtained by inverting the signal 54*a* in the reverse amplification circuit 56 so as to coincide with the inverting in the integrating circuit 55 are inputed into the differential amplification circuit 58 so as to take a difference between the signals 55*a* and 56*a*. When the difference exceeds a predetermined value, a command signal is output to the blower 1 to operate it with a desired high-speed rotation. On the other hand, the signal 54*a* is compared with a reference signal in the differential amplification circuit 57. When the signal 54*a* is less than the reference signal by a predetermined value, a command signal is output to the blower 1 to operate it with a desired low-speed rotation.

Figure 14:
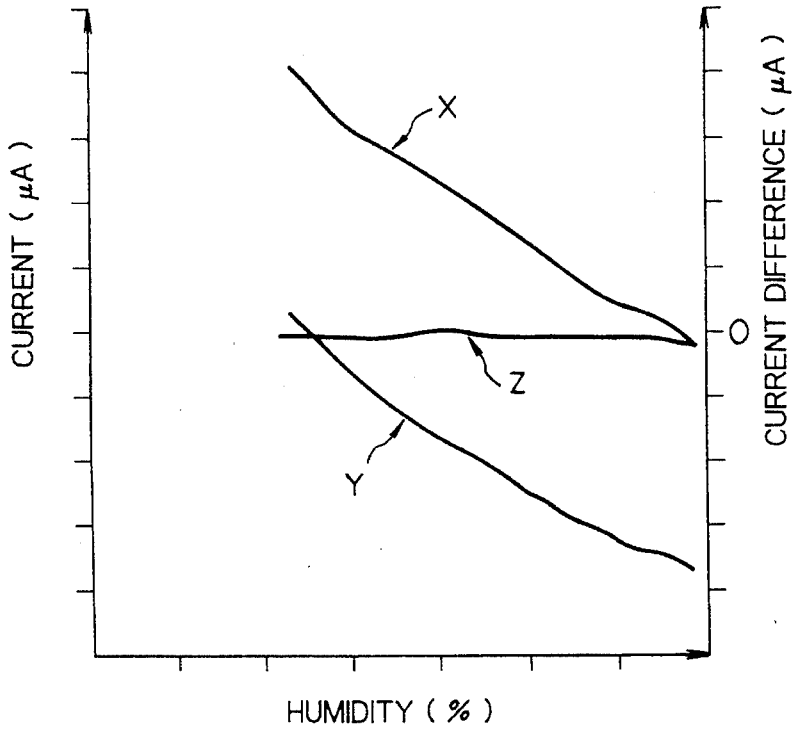
FIG. 14 is a graph showing humidity dependency of the discharge current.

In the air purifier thus arranged as described above, the air passing between the discharge electrodes 31A and 31B is the same in humidity as the air passing between the reference electrodes 32A and 32B. Accordingly, the discharge current values of the electrodes 31A and 31B, and of the electrodes 32A and 32B decrease with the same tendency in accordance with an increase in humidity as indicated by graphs X and Y shown in FIG. 14, respectively. Accordingly, a difference between the discharge current signals after amplification in the amplification circuits 53A and 53B is substantially 0 (zero) as indicated by a graph z under a condition that no smoke particles exist. Namely it is possible to cancel the fluctuation in the discharge current due to a change in humidity by air conditioning within a compartment.

When the person smokes within the compartment, the air containing the smoke particles pass through the discharge electrodes 31A and 31B. Since the smoke particles take away negative ions of the corona discharge, the discharge current decreases. On the other hand, since clean air in which the smoke particles are removed by the dust separator 35 passes through the reference electrodes 32A and 32B, the discharge current does not come under the influence of the smoke particles.

Therefore, a difference in the discharge currents between the discharge electrodes 31A and 31B and the reference electrodes 32A and 32B accurately corresponds to the concentration of the smoke particles, that is, the degree of contamination. In case that the rotation speed of the blower 1 is controlled in accordance with the degree of contamination, it is possible to operate the blower with a reduction in noise and in battery load.

[FIFTH EMBODIMENT]

Figure 15:
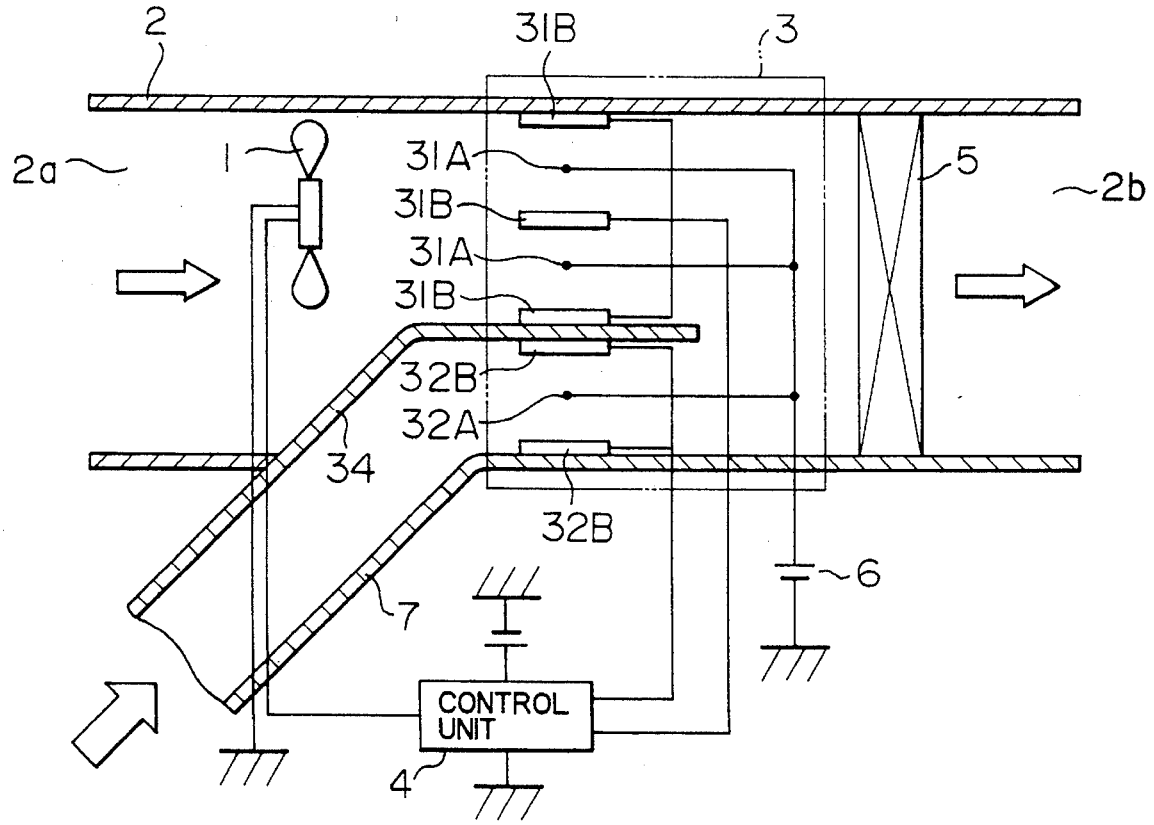
FIG. 15 is an entire schematic cross-sectional view of an air purifier according to a fifth embodiment of the invention.

In place of the dust separator 35, it may be possible to introduce the conditioned air towards the reference electrodes 32A and 32B. As shown in FIG. 15, a duct 7 is provided on a side wall of the housing 2, through which the conditioned air from the air conditioner is supplied to the reference electrodes 32A and 32B. In this case, it is necessary that the conditioned air is clean air from which the dust and the smoke particles are removed by a filter within the air conditioner. The humidity within the air flow passage through which the air within the compartment flows is substantially the same as that of the conditioned air. Therefore, advantages similar to those of the above-described embodiments can be obtained.

[SIXTH EMBODIMENT]

Figure 16:
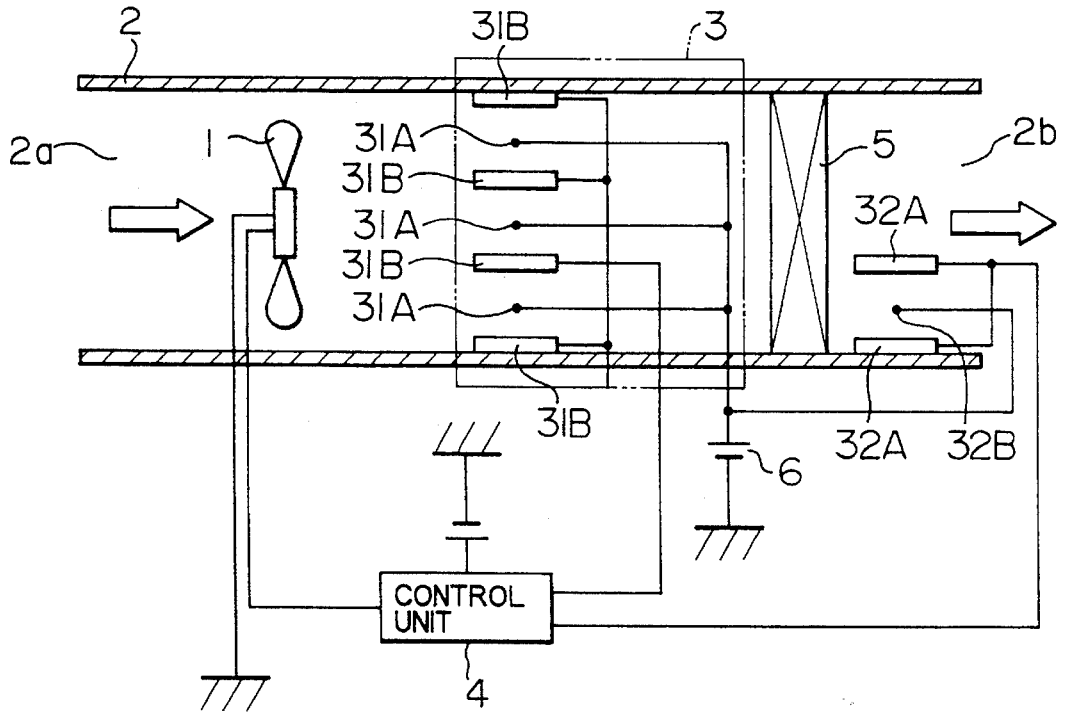
FIG. 16 is an entire schematic cross-sectional view of an air purifier according to a sixth embodiment of the invention.

As shown in FIG. 16, it may be possible to locate the reference electrodes 32A and 32B downstream of the scavenging filter 5. In this case, the clean air from which the smoke particles are removed passes through the electrodes 32A and 32B. Therefore, advantages similar to those of the aforementioned embodiments can be obtained. Further, according to this embodiment, the dust separator 35 and the duct 7 can be omitted.

In each of the above-described embodiments, a difference of the discharge current between the discharge electrodes 31A and 31B and the reference electrodes 32A and 32B is detected, whereby it is possible to remove an error due to fluctuation of humidity, and it is also possible to remove also an error accompanied with the fluctuation in battery voltage and the ripple of high-tension power source.

What is claimed is:

1. An air purifier comprising:

an air flow passage;

means for blowing the air through said air flow passage;

emission electrodes for generating a corona emission in said air flow passage;

a control unit for detecting an emission current of said emission electrodes, the emission current decreasing as a contamination level of the air increases, and for controlling a rotational speed of said blowing means inversely with the detected emission current value, so that the blowing means rotational speed increases as the contamination level increases; and means positioned at a downstream side of said emission electrodes for scavenging contaminated particles within the air which is charged through said emission electrodes.

2. An air purifier according to claim 1, wherein said emission electrodes are a pair of electrodes opposite from each other, one of which is in a form of a plate extending along the air flow in said air flow passage, and the other being so formed that an edge of the other electrode opposing to said one electrode includes a plurality of aligned discrete pinpoints.

3. An air purifier according to claim 2, wherein said emission electrodes are spaced from each other along the air flow, one of which is in a form of a lattice defining a plurality of square spaces, and the other having at the edge thereof a plurality of triangular projections whose tips are located respectively at centres of said square spaces and terminate at a plane including an opening end of said lattice.

4. An air purifier according to claim 1, wherein said emission electrodes are a pair of electrodes opposite from each other, one of which includes a planar portion extending along the air flow in said air flow passage, and the other being so formed that an edge of the other electrode opposing to said one electrode extends linearly.

5. An air purifier according to claim 4, wherein each of said other electrodes is a wire.

6. An air purifier according to claim 1, wherein said emission electrodes include first electrodes and second electrodes each of which is spaced from each other in a direction perpendicular to the air flow and is disposed between two adjacent said first electrodes, and wherein each of said first electrodes is in a form of a plate, and each of said second electrodes is provided at opposite edges thereof with triangle projections facing said first electrodes, the triangle projections provided on one edge alternate with the triangle projections provided on the other edge.

7. An air purifier according to claim 1, further comprising:

reference electrodes for generating a corona emission in a clear air flow passage through which the air from which contaminated particles are removed passes;

wherein said control unit comprises means for detecting a difference in an emission current between said emission electrodes and said reference electrodes; and said control unit is for controlling a rotational speed of said blowing means in accordance with a magnitude of the detected emission current difference.

8. An air purifier according to claim 7, wherein said clean air flow passage is provided with a dust separator located at an upstream side of said reference electrodes.

* * * * *